US005595436A

United States Patent [19]

Way, Jr. et al.

[11] Patent Number: 5,595,436

[45] Date of Patent: Jan. 21, 1997

[54] FLASHLIGHT WITH ARTICULATING STAND

[75] Inventors: Lowell B. Way, Jr., Laguna Niguel; Martin I. Sheps, Poway, both of Calif.

[73] Assignee: Diamondlight Industries, Inc., Costa Mesa, Calif.

[21] Appl. No.: 559,906

[22] Filed: Nov. 17, 1995

[51] Int. Cl.[6] ..... F21L 7/00

[52] U.S. Cl. ..... 362/190; 362/191

[58] Field of Search ..... 362/190, 191, 362/195

[56] References Cited

U.S. PATENT DOCUMENTS

| | | | |
|---|---|---|---|
| 2,125,038 | 7/1938 | Tompkins et al. | 240/10.66 |
| 2,282,167 | 5/1942 | Cullman | 240/10.69 |
| 3,428,800 | 2/1969 | Levin et al. | 240/41.3 |
| 3,543,016 | 11/1970 | Jones | 240/3 |
| 3,813,004 | 5/1974 | Andreaggi | 220/96 |
| 3,919,547 | 11/1975 | Foote | 250/253 |
| 4,208,703 | 6/1980 | Orr | 362/190 |
| 4,307,862 | 12/1981 | Claussen | 248/121 |
| 4,410,933 | 10/1983 | Blake et al. | 304/248 |
| 4,907,769 | 3/1990 | Hunley, Jr. et al. | 248/185 |
| 4,938,440 | 7/1990 | Weinfield | 248/183 |
| 5,134,558 | 7/1992 | Williams et al. | 362/263 |
| 5,171,086 | 12/1992 | Baloochi | 362/188 |
| 5,469,345 | 11/1995 | Pettersen et al. | 362/188 |

*Primary Examiner*—Carroll B. Dority
*Attorney, Agent, or Firm*—Stetina Brunda & Buyan

[57] ABSTRACT

A flashlight comprising an elongate housing having front and back ends. Disposed within the housing is a power source, while disposed within the front end of the housing is a light source which is electrically connected to the power source. Pivotally connected to the housing is a stand member which is movable between a collapsed position and a deployed position. The stand member is operable to support the housing at a desired angle relative to a generally planar surface when moved to the deployed position and rested upon the surface.

13 Claims, 3 Drawing Sheets

FLASHLIGHT WITH ARTICULATING STAND

FIELD OF THE INVENTION

The present invention relates generally to portable flashlights, and more particularly to such a flashlight having a deployable, articulating stand incorporated into the housing, to support the flashlight at a desired angle from a flat surface.

BACKGROUND OF THE INVENTION

Portable flashlights and separate flashlight holders are well known and useful devices. In performing work outdoors or engaging in leisure activities at night, an artificial light source is frequently required. For example, in performing car repair at night it is often necessary to either suspend an electric lantern above the engine compartment, strategically rest a flashlight on the fender, or ask an assistant to hold the flashlight to facilitate the illumination of the area of the motor under repair. In another example, when changing a tire on the shoulder of a dark road, it may be necessary to support the flashlight to direct its beam of light at the wheel being removed and replaced. In the event of emergency repairs being done after darkness due to an earthquake or extreme weather conditions, such as attending to a broken pipe or a severed line, again it may be necessary to support a flashlight to direct its beam of light at the area being repaired. Additionally, in leisure activities such as camping, it is often desirable to read at night in which case the flashlight must be supported so that the beam shines upon the book pages.

The most common type of portable flashlight now in general use is one having a large cylindrical canister for the in-line storage of four D-cell batteries, a spring contact and switch, and a screw-on threaded cap containing an electric contact, the light bulb, and lens. Such conventional flashlights are bulky, and typically do not produce well-collimated light.

Conventional separate flashlight holders are even more large and cumbersome. Such flashlight holders typically include a C-shaped clamp that holds the flashlight. The clamp is attached to the flashlight by an arm that may swivel and/or rotate, the arm being further attached to a tripod support which may have adjustable legs. Obviously, such a flashlight holder is not portable together with the flashlight.

To improve over the prior art, it is desirable to provide a portable flashlight also incorporating an articulating stand which, when deployed, is capable of supporting the flashlight at a desired angle for work situations or for leisure in which additional light directed at a particular area is needed. Additionally, it is desirable to provide a compact flashlight which produces a powerful, well-collimated beam of light. Also, it is desirable to provide a flashlight having components which are easily assembled for inexpensive manufacturing, and it is desirable to provide a flashlight having an electrical system that is accessible for maintenance and repair. The proposed improvements, to Applicant's knowledge, have heretofore never been addressed.

SUMMARY OF THE INVENTION

The present invention improves over the prior art in a number of respects. The present invention comprises a flashlight having an elongate housing, light source, and power source disposed in the housing. The flashlight further includes an articulating stand connected to the housing.

When deployed, the stand may be used to support the flashlight at a desired angle relative to a substantially flat surface upon which the flashlight is rested. The stand is collapsible so as to be stored and carried along with the flashlight.

In a preferred embodiment of the invention, the stand itself includes a pair of pivoting legs which may be spread apart (i.e., angularly displaced relative to each other) to improve the stability of the stand in supporting the flashlight housing, and the pivoting legs may be collapsed when the stand is not in use. Though the housing may be of a substantially constant cross-section along its length, its outer surface is preferably formed to include a recess to receive the stand in its collapsed position for storage, such that the stand is in substantial alignment with the outer surface of the housing. The articulating stand may additionally be connected to the housing with multi-position detents, to provide pivoting and support capability at fixed angles.

The preferred embodiment of the present invention is a precision assembly of components which is easily manufactured. The flashlight preferably includes a sliding cartridge which holds the batteries, the cartridge and housing being configured to insure proper positioning and orientation relative to each other. The light source is located relative the cartridge such that an electrical connection is made to the batteries. A T.I.R. (total internally reflecting) lens is located relative the light source such that a collimated beam of light is produced when the light source is activated. The flashlight housing additionally includes a plurality of seals to provide a water-tight construction when the housing is closed.

These, as well as other advantages of the present invention will become more apparent from the following description and drawings. It is understood that changes in the specific structure shown and described may be made within the scope of the claims without departing from the spirit of the invention.

DETAILED DESCRIPTION OF THE PREFERRED EMBODIMENT

The detailed description set forth below in connection with the appended drawings is intended as a description of the presently preferred embodiment of the invention, and is not intended to represent the only form in which the present invention may be constructed or utilized. The description sets forth the functions and sequences of steps for constructing and operating the invention in accordance with the illustrated embodiment. It is to be understood, however, that the same or equivalent functions and sequences may be accomplished by different embodiments that are also intended to be encompassed within the spirit and scope of the invention.

Figure 1:
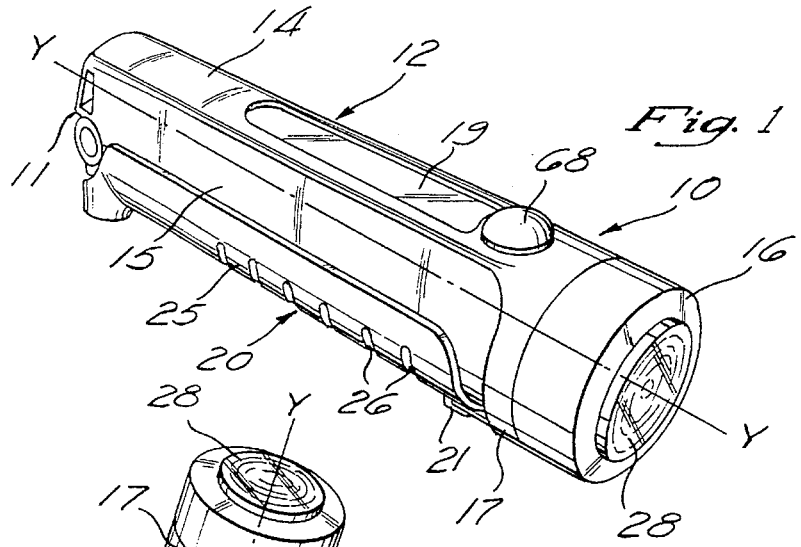
FIG. 1 is a front perspective view of the flashlight constructed in accordance with the present invention, the articulating stand being shown in its collapsed position.
Figure 2:
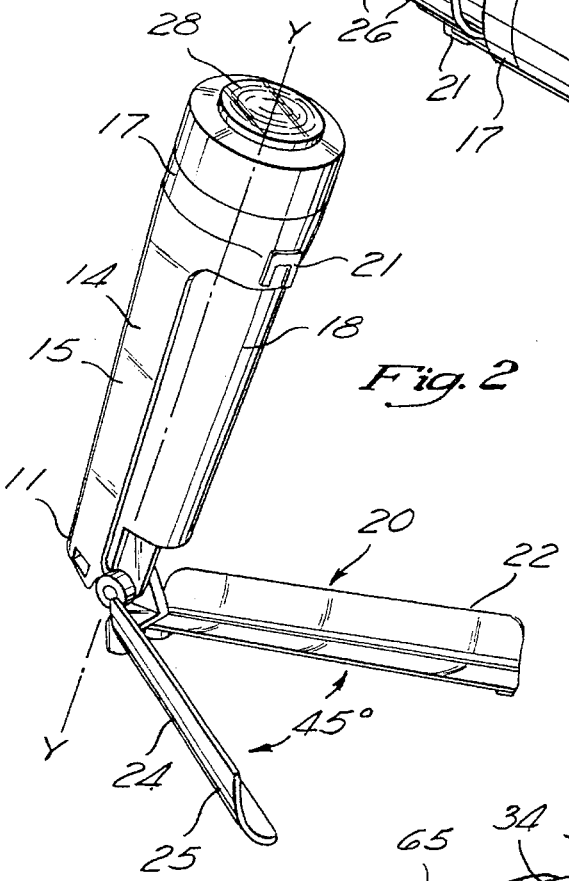
FIG. 2 is a perspective view of the flashlight shown in FIG. 1 with the articulating stand being shown in its deployed position.
Figure 7:
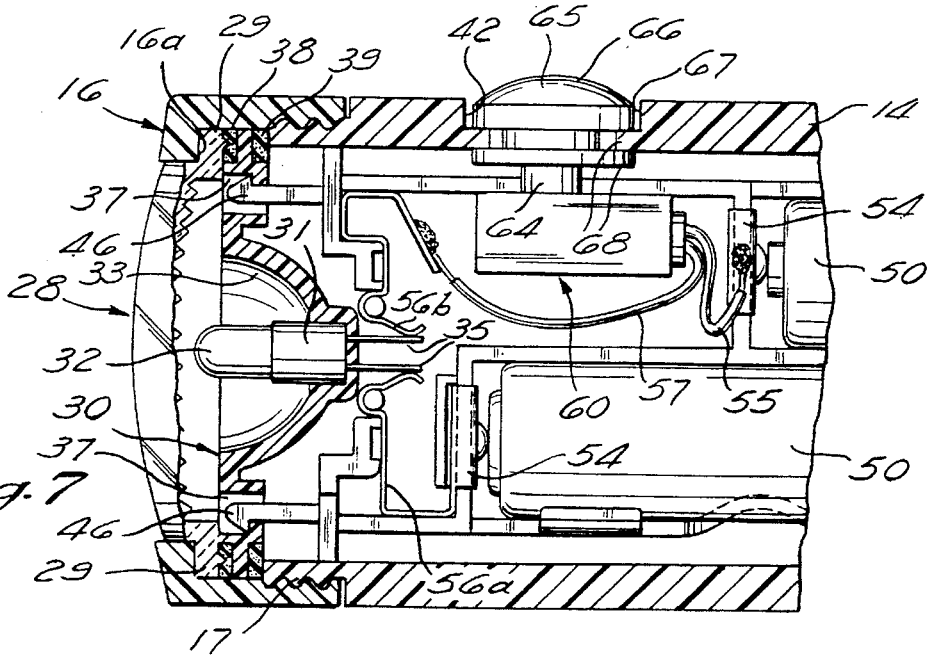
FIG. 7 is a partial cross-sectional view of the front end of the flashlight housing, further showing the on/off switch of the flashlight.
Figure 8:
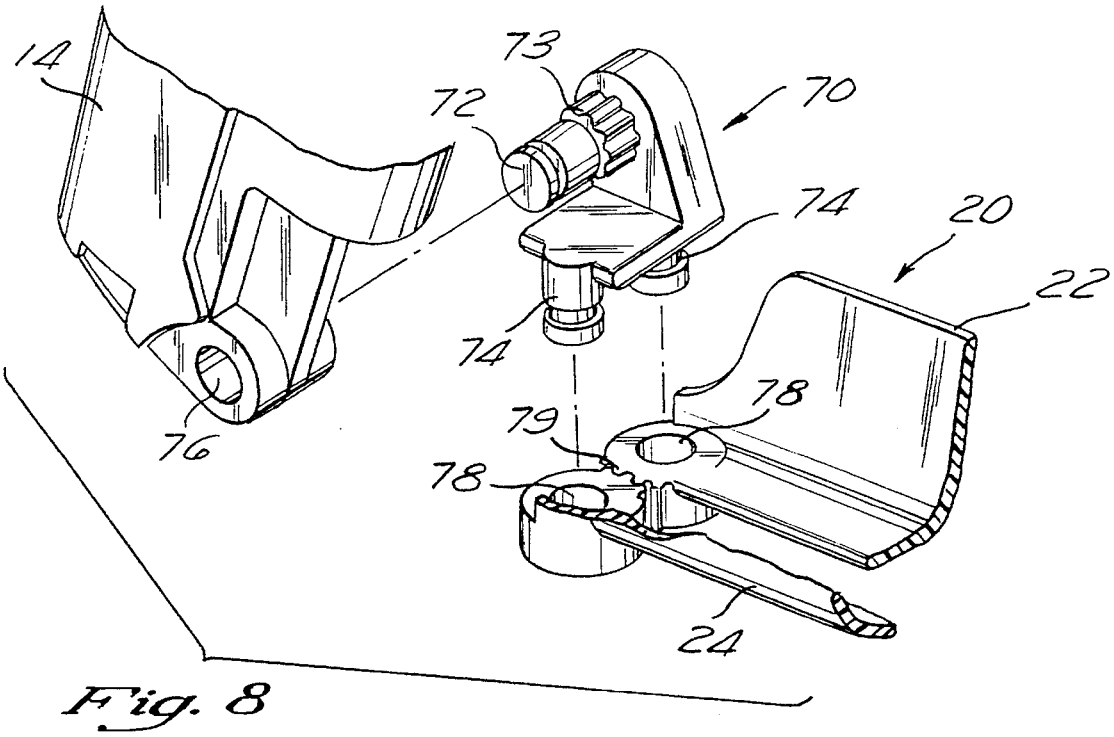
FIG. 8 is an exploded view of the multi-position components of the articulating stand.
Figure 9:
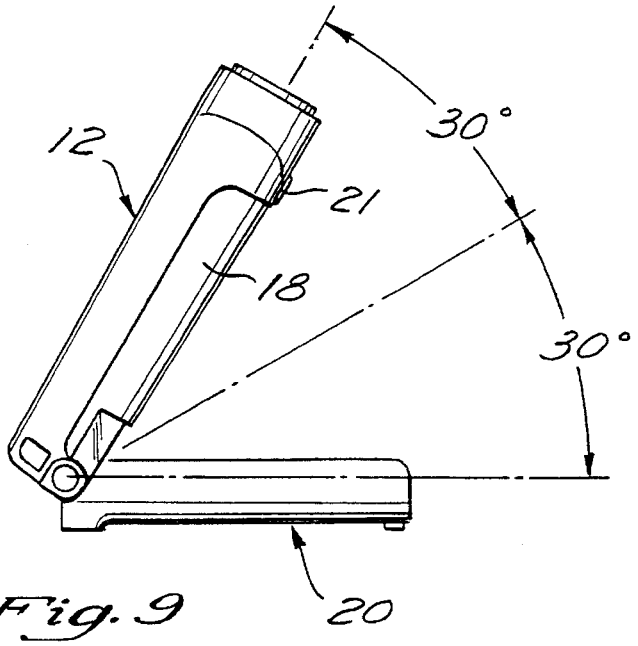
FIG. 9 is a side elevational view illustrating the range of angular displacement of the flashlight housing relative to the stand.

The portable flashlight with a deployable, articulating stand of the present invention is illustrated in FIGS. 1–9 which depicts a presently preferred embodiment of the invention. Referring first to FIGS. 1 and 2, the flashlight 10 is comprised generally of a cylindrically-shaped housing 12 defining a longitudinal axis Y—Y. The housing 12 includes an elongate body portion 14 which defines a back end 11 and an externally threaded front end 17. Threadably engaged to the front end 17 of the housing 12 is a cap portion 16. The portable flashlight 10 additionally includes an articulating stand 20 having a pair of pivoting legs 22, 24. In the preferred embodiment, the stand 20 is movable between a deployed position (as shown in FIG. 2) and a collapsed position (as shown in FIG. 1). When moved to the deployed position, the stand 20 is used to support the housing 12 at a desired angle relative to a flat surface as shown in FIGS. 2 and 9.

The body 14 of the housing 12 further defines an exterior surface 15 which includes an elongate, arcuately shaped recess 18 formed therewithin. The recess 18 is sized and configured to receive the articulating stand 20 in a nesting fashion when the same is moved to the collapsed position. In this respect, when the stand 20 is collapsed and received into the recess 18, the exposed, exterior surfaces of the legs 22, 24 are substantially continuous with the exterior surface 15 of the body 14 surrounding the recess 18. As best seen in FIG. 1, the exterior surfaces of the legs 22, 24 each preferably include a series of recessed grooves 26 formed therewithin to aid in the gripping of the flashlight 10 when the stand 20 is collapsed and received into the recess 18.

The body portion 14 of the housing 12 may further include additional features, such as a land 19 for application of a personal identification plate or manufacturer's trademark. The body portion 14 could also include a flexible clip (not shown) such that a user could attach the flashlight 10 to his or her belt, pants pocket, or the like. The structural components, i.e., housing 12, stand 20, etc., of the flashlight 10 are preferably all fabricated of conventional molded plastic, offering the advantages of light weight and low cost.

Figure 4:
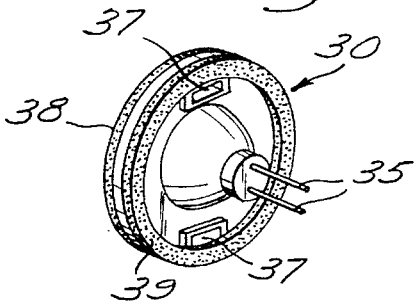
FIG. 4 is a rear perspective view of the flashlight light source.
Figure 3:
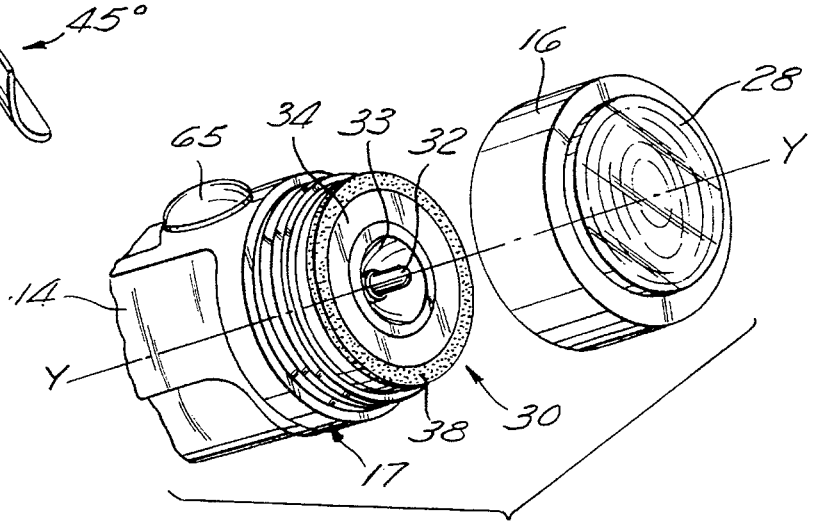
FIG. 3 is an exploded view of the light source and lens of the flashlight housing.

Referring now to FIGS. 3 and 4, the flashlight 10 of the present invention may be described with greater particularity. The flashlight 10 includes a light source 30 which is received into the open front end 17 of the body 14. In the preferred embodiment, the light source 30 comprises a light bulb 32 which resides within a reflective dome 33 defining a concave inner surface. As best seen in FIG. 4, the light bulb 32 includes a pair of electrical contacts 35 which extend rearwardly from the outer surface of the dome 33. The light source 30 further includes an annular reflective strip 34 which circumvents the dome 33, and hence the light source 32, as seen in FIG. 3. Additionally, circumventing the reflector 34 as well as the outer surface of the dome 33 is a pair of identically configured, annular seals 38, 39, the use of which will be discussed in more detail below.

As previously indicated, the cap portion 16 of the housing 12 is threadably connected to the externally threaded front end 17 of the body 14. The cap portion 16 includes a T.I.R. lens 28 preferably constructed in accordance with U.S. Pat. No. 4,337,759 (issued Jul. 6, 1982), the disclosure of which is expressly incorporated by reference. The T.I.R. lens 28 includes an arcuately contoured central portion which is circumvented by an annular, radially extending flange portion 29. The inner surface of the central portion of the T.I.R. lens 28 has multiple facets, each facet having an entry, reflective, and exit face, which harness a large portion of the light created and redirects it into a collimated beam. The T.I.R. lens enables a powerful, well-focused beam of light to be produced from a compact flashlight. Further details of the installation of the T.I.R. lens 28 and light source 30 into the housing 12 will be discussed below in connection with FIG. 7.

Figure 5:
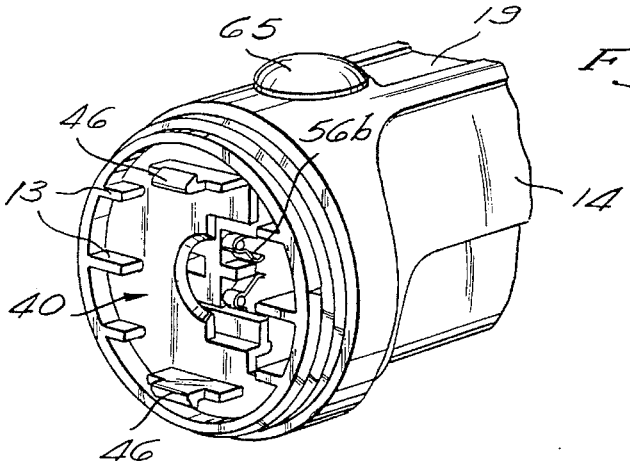
FIG. 5 is a perspective view of the power supply cartridge installed in the flashlight.
Figure 6:
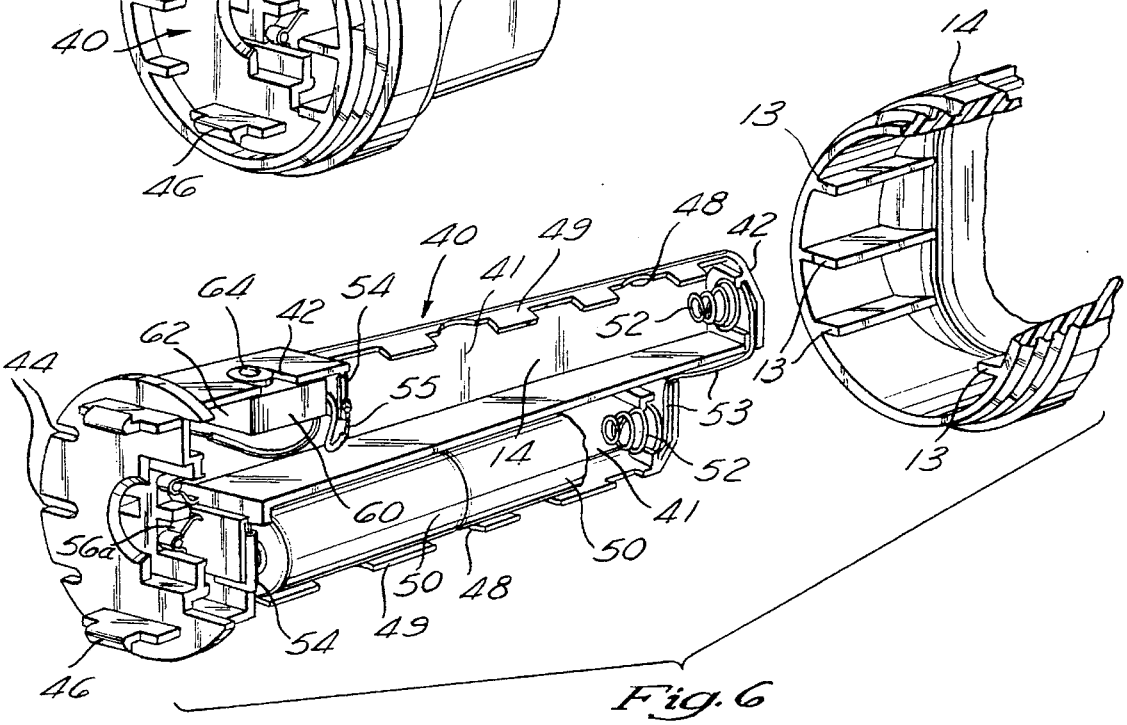
FIG. 6 is a perspective view of the power supply cartridge as removed from within the flashlight housing.

Referring now to FIGS. 5 and 6, the configuration of the interior of the housing 12 may be described. Slidably insertible into and removable from within the body portion 14 of the housing 12 is an elongate cartridge 40 which is sized and configured to accommodate the power source of the flashlight 10. In the preferred embodiment, the power source comprises four (4) "A—A" sized batteries 50. As best seen in FIG. 6, the cartridge 40 defines a pair of elongate cavities 41 which extend in side-by-side relation to each other, each of which is adapted to receive two (2) batteries 50 in end-to-end fashion. Each of the cavities 41 includes a spring contact 52 and a barb contact 54 positioned at respective ones of the opposed ends thereof. Once secured within the cavities 41, the batteries 50 are electrically connected to the light source 30 in a manner which will be described in more detail below.

Referring now to FIGS. 5–7, the spring contacts 52 of the cartridge 40 are electrically connected to each other by a wire 53. Additionally, as best seen in FIG. 7, the barb contact 54 of one of the cavities 41 is directly connected to a first spring contact 56(*a*), with the barb contact 54 of the other cavity 41 being electrically connected to an on/off switch 60 via a wire 55. The switch 60 preferably comprises a conventional single-pole, off/on electrical switch 62. The switch 62 is itself electrically connected to a second spring contact 56(*b*) via a wire 57. The switch 62 is mounted within the cartridge 40 in a manner wherein a switch button 64 of the switch 62 resides within a slot 42 defined within the cartridge 40.

As previously indicated, the cartridge 40 is slidably insertible into and removable from within the body 14 of the housing 12 to facilitate easy access to the batteries 50 when the same must be replaced. The removable cartridge 40 also aids in the maintenance of the electrical system of the flashlight 10 in that the electrical switch 62, contacts 52, 54, 56(*a*), 56(*b*) and associated wiring are all easily accessible once the cartridge 40 is removed from within the body 14.

To guide the reinsertion of the cartridge 40 into the body 14, formed within the peripheral edge of the circularly configured front end of the cartridge 40 are three (3) registry slots 44 which are sized and configured to receive three (3) complementary, longitudinally extending indexing tabs 13 formed on the inner surface of the body 14 adjacent the front end 17 in substantially parallel relation to each other. Advantageously, the receipt of the indexing tabs 13 into respective ones of the slots 44 insures proper clockwise orientation and longitudinal positioning of the cartridge 40 within the body 14 of the housing 12, which is needed for the proper assembly and functioning of the flashlight 10. As further seen in FIG. 6, the cartridge 40 also includes a series of cutouts 48 formed within the longitudinal edges 49 thereof defining the cavities 41. As will be recognized, these cutouts 48 are used to aid in the removal of the batteries 50 from within respective ones of the cavities 41 defined within the cartridge 40.

Referring again to FIG. 7, the body portion 14 of the housing 12 includes a small, circular opening 67 which, when the cartridge 40 is inserted into the body 14, is coaxially aligned with the switch contact 64 of the switch 62. Disposed within the opening 67 is a conventional push-button 65 which includes a flexible cover 66 applied thereto. The push-button 65 is interfaced to the button 64 of the switch 62. In this respect, the application of pressure to the dome-shaped outer surface of the push-button 65 facilitates the actuation of the switch 62 between its on and off modes.

As previously indicated, the light source 30 of the flashlight 10 is inserted into the front end 17 of the body 14. In particular, the light source is attached to the front end of the cartridge 40 via the receipt of a pair of identically configured tabs 46 extending forwardly from the circularly configured front end of the cartridge 40 into respective ones of a corresponding pair of slots 37 defined within the light source 30, as seen in FIG. 4. Importantly, when the tabs 46 are received into the slots 37, the contacts 35 of the light source 30, and in particular the light bulb 32, are forced between the spring contacts 56(*a*), 56(*b*) of the cartridge 40. As will be recognized, once the light source 30 is installed into the housing 14 and attached to the cartridge 40 in the aforementioned manner, an electrical circuit is defined by the batteries 50, spring contacts 52, wire 53, barb contacts 54, spring contacts 56(*a*), 56(*b*), contacts 35, wires 55, 57, and switch 62. Importantly, this electrical circuit may be Selectively interrupted by the actuation of the push-button 65 and hence the switch 62. In this respect, when the switch 62 is actuated to the off mode, the electrical circuit is interrupted. Conversely, when the switch 62 is actuated to the on mode, the electrical circuit is completed, thus energizing the light bulb 32 and facilitating the illumination thereof.

The flashlight constructed in accordance with the present invention is adapted to be of water-tight construction. The lens 28 is installed in the cap portion 16 in a manner wherein the flange portion 29 thereof rests against an annular shoulder 16*a* defined by the cap portion 16. When the cap portion 16 (including the lens 28 inserted thereinto) is threadably connected to the front end 17 of the housing 14, the seals 38, 39 of the light source 30 are compressed between the flange portion 29 of the lens 28 and the front end 17 of the body 14. The flange portion 29 is itself rigidly captured between the seal 38 and the annular shoulder 16*a* defined by the cap portion 16. Advantageously, the compression of the seals 38, 39 between the front end 17 and flange portion 29 prevents any water leaking between the threaded connection of the cap portion 16 to the body 14 from seeping into the interior of the housing 12. Additionally, the push-button 65 is provided with a seal portion 68 which prevents the seepage of moisture through the aperture 67 into the interior of the housing 12.

Referring now to FIGS. 8 and 9, as previously explained, the articulating stand 20 of the flashlight 10 is pivotally connected to the housing 12. In the preferred embodiment, the pivotal connection of the stand 20 to the housing 12 is facilitated by an adapter member 70. The adaptor 70 includes a cylindrically configured transverse pin 72 having an indexing portion 73 formed thereabout and extending partially along the length thereof. In addition to the transverse pin 72, the adapter includes a pair of identically configured, downwardly extending vertical pins 74. In the flashlight 10, the pin 72 is extensible into an aperture 76 defined within the body 14 of the housing 12 adjacent the back end 11 thereof. Though not shown, a portion of the aperture 76 has a configuration which is complimentary to that of the indexing portion 73 and is sized and configured to receive the same. As will be recognized, due to the inclusion of the indexing portion 73 upon the pin 72 and the aperture 76 being configured to accommodate the indexing portion 73, the receipt of the pin 72 (including the indexing portion 73) into the aperture 76 facilitates the formation of a multi-position detent, with the angular orientation of the body 14 relative to the adaptor 70 being dependent upon the orientation of the indexing portion 73 of the pin 72 when inserted into the aperture 76. Advantageously, due to the inclusion of the indexing portion 73 and complimentary aperture 76, the housing 14 is movable between multiple, separate angular orientations relative to the adaptor 70, and hence the stand 20.

As further seen in FIG. 8, formed within the back ends of the legs 22, 24 of the stand 20 are apertures 78 which are sized and configured to receive respective ones of the vertical pins 74 of the adaptor 70. Though not shown, the vertical pins 74 and apertures 78 may be formed to include complimentary mating teeth and detents to facilitate the positive engagement therebetween. Those portions of the legs 22, 24 in which the apertures 78 are defined are formed to include gear teeth 79 which are cooperatively engaged to each other and function to limit the angular separation of the legs 22, 24 from each other when the stand 20 is fully deployed. In the flashlight 10, the angle between the pivoting legs 22, 24 of the stand 20 may be fixed at zero or forty-five degrees, as well as any angle therebetween. As seen in FIG. 9, the body 14 of the housing 12 may optionally include a sliding latch member 21 engageable thereto which is adapted to maintain the legs 22, 24 of the stand 20 within the recess 18 when the stand 20 is moved to the collapsed position and nested within the recess 18.

As previously indicated, installation of the flashlight 10 power source and maintenance of the electrical system are facilitated through the sliding of the cartridge 40 in and out of the housing 12. To install or replace the batteries 50, the cap portion 16 of the housing 12 is removed, and the cartridge 40 pulled forward along the longitudinal axis Y—Y until entirely removed from the interior of the body portion 14 of the housing 12. As will be recognized, the light source 30 is maintained in engagement to the cartridge 40 when the same is removed from within the interior of the body portion 14. When the cartridge 40 (including the light source 30) is removed from within the body 14, the other electrical system components, i.e., the light bulb 32, the electric switch 62, or the contacts 52, 54, 56*a*, 56*b* and associated wiring, are accessible if maintenance is necessary. To reassemble the flashlight 10 after replacing the power source, light source 30, or doing any repair, the steps are merely reversed. In this respect, the re-insertion of the cartridge 40 into the body 14 is limited by the abutment of the seal 39 of the light source 30 against the front end 17 of the body portion 14.

Use of the articulating stand 20 is simple and effective in supporting the housing 12 of the flashlight 10 at an angle from about 0 to 90 degrees relative to any substantially flat surface. The stand 20 offers two axes of articulation. First, the housing 12 is pivoted about its back end relative to the stand 20 (see FIG. 9), and then the legs 22 and 24 of the stand 20 are pivoted apart (FIG. 2) to provide a more stable support for the housing 12. The stand 20 may be configured such that the pivoting about the two axes is at any angle within the range of articulation, or it may be configured with multi-position detents such that the desirable pivot angles are predetermined.

The articulating stand 20 is collapsible, and connected to the housing 12 so as to be an integral part of the flashlight 10. As best illustrated in FIG. 1, the stand 20 collapses into the recess 18 within the exterior surface of the body portion 14, such that the stand 20 is unobtrusive when not in use. The gripping means 26 of the stand 20 add to the overall graspability of the portable flashlight 10.

It is understood that the portable flashlight 10 described herein and shown in the drawings represents only a presently preferred embodiment of the invention. Indeed, various modifications and additions may be made to the illustrated embodiment without departing from the spirit and scope of the invention. These and other modifications and additions may be obvious to those skilled in the art and may be implemented to adapt the present invention for use in a variety of different applications.

What is claimed is:

1. A flashlight comprising:

an elongate housing having a front end and a back end;

a cartridge slidably disposed in said housing, the cartridge holding a power source;

a light source disposed in the front end of said housing, said light source being electrically connected to said power source; and a stand member pivotally connected to said housing and movable between a collapsed position and a deployed position, said stand member being operable to support the housing at a desired angle relative to a generally planar surface when moved to the deployed position and rested upon the surface.

2. The flashlight of claim 1 wherein:

said stand member comprises a pair of elongate leg members having opposed first and second ends, said first ends being pivotally connected to each other such that the second ends may be angularly separated from each other to improve the stability of the housing when the stand member is moved to the deployed position and rested upon the surface.

3. The flashlight of claim 1 wherein:

said housing is formed to include a recess sized and configured to receive the stand member in a nesting fashion when the stand member is moved to the collapsed position;

said stand member being substantially continuous with said housing when received into said recess.

4. The flashlight of claim 3 wherein:

said stand member is formed to have gripping means in an exposed surface of the stand member when pivoted within the recess.

5. The flashlight of claim 1 wherein:

the stand member is pivotally connected to the housing via a multi-position detent member.

6. The flashlight of claim 1 wherein:

said cartridge and said housing have corresponding indexing means to ensure proper orientation of the cartridge in the housing.

7. The flashlight of claim 1 further including:

a single-pole, double-throw switch disposed within the housing, said switch being electrically connected to the power source and the light source.

8. The flashlight of claim 7 wherein:

said switch is slidably attached to the cartridge.

9. The flashlight of claim 7 wherein:

the housing has a first pair of electrical contacts electrically connected to the power source; and said light source has a second pair of electrical contacts which are electrically connected to the first pair of contacts to form an electrical circuit between the power source and the light source, the switch being operable to selectively interrupt the electrical circuit.

10. The flashlight of claim 7 further comprising:

a T.I.R. lens attached to the front end of said housing.

11. The flashlight of claim 10 wherein:

said light source and said lens are configured and oriented relative to each other so as to define a focal length which produces a substantially collimated beam of light when the light source is activated.

12. The flashlight of claim 10 further comprising:

a cap portion removably connected to the front end of said housing, said lens being disposed in said cap portion;

a first seal disposed between the lens and said cap portion;

a second seal disposed between said cap portion and said housing; and a third seal formed between said switch and said housing; whereby said seals provide the flashlight with a substantially water-tight construction.

13. The flashlight of claim 3 further including:

a latch member movably attached to the housing to maintain the stand when within the recess.

* * * * *